US009826793B2

(12) United States Patent
Miller et al.

(10) Patent No.: US 9,826,793 B2
(45) Date of Patent: Nov. 28, 2017

(54) MASK COUPLING APPARATUS

(71) Applicant: The United States of America as represented by the Secretary of the Navy, Washington, DC (US)

(72) Inventors: Colt Miller, Bloomington, IN (US); Bradley Moan, Greenwood, IN (US); Thomas Gailey, Springlake, NC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 119 days.

(21) Appl. No.: 14/757,681

(22) Filed: Dec. 23, 2015

(65) Prior Publication Data

US 2017/0181491 A1 Jun. 29, 2017

(51) Int. Cl.

| | |
|---|---|
| ***A42B 3/04*** | (2006.01) |
| ***A42B 3/20*** | (2006.01) |
| ***A42B 7/00*** | (2006.01) |
| ***A42B 3/28*** | (2006.01) |
| ***A44B 11/25*** | (2006.01) |
| ***A42B 3/08*** | (2006.01) |
| ***A62B 18/08*** | (2006.01) |
| ***A62B 18/02*** | (2006.01) |

(Continued)

(52) U.S. Cl.

CPC ..... *A42B 3/288* (2013.01); *A42B 3/085* (2013.01); *A44B 11/25* (2013.01); *A62B 18/025* (2013.01); *A62B 18/084* (2013.01); *A62B 23/02* (2013.01)

(58) Field of Classification Search

CPC ..... A42B 3/20; A42B 3/0473; A42B 3/08; A42B 3/145; A42B 3/0406; A42B 3/328; A42B 3/00; A42B 3/142; A42B 3/04; A42B 3/18; A42B 1/24; A42B 3/085; A42B 3/225; A42B 3/228; A63B 71/10; A63B 2102/14; A63B 2102/22; A63B 2102/24; A63B 2243/007; A63B 2243/0066; A41D 13/0512; A41D 2600/102; A44B 11/2588; A44B 11/266

See application file for complete search history.

(56) References Cited

U.S. PATENT DOCUMENTS

| | | | |
|---|---|---|---|
| 2,414,405 | A | 11/1947 | Bierman |
| 2,867,812 | A | 1/1959 | Roth et al. |
| 3,035,573 | A | 5/1962 | Morton et al. |

(Continued)

FOREIGN PATENT DOCUMENTS

| | | |
|---|---|---|
| DE | 3509784 | 9/1986 |
| DE | 102013223941 | 5/2015 |

(Continued)

OTHER PUBLICATIONS

MSA Safety Incorporated Product Literature for 3S Full-Face Helmet Mask, retrieved from the Internet Nov. 10, 2015, and available at www.msasafety.com; 2 pages.

(Continued)

*Primary Examiner* — Bobby Muromoto, Jr.

(74) *Attorney, Agent, or Firm* — Christopher A Monsey

(57) ABSTRACT

A mask coupling apparatus coupled to an outer surface of a helmet and couplings of a mask including an adjusting mechanism comprising a single elastic strap coupled to the mask at both ends via the couplings, where the ends of the elastic strap are free to adjust the length of the mask coupling apparatus.

23 Claims, 4 Drawing Sheets

(51) Int. Cl.
*A62B 23/02* (2006.01)
*A42B 3/00* (2006.01)

(56) References Cited

U.S. PATENT DOCUMENTS 3,698,670 A * 10/1972 Ewing ..... B64D 25/02 244/122 AG
3,714,668 A * 2/1973 Mirabella ..... A42B 3/145 2/419
3,784,805 A * 1/1974 Rolle ..... G01S 7/003 367/104
3,792,257 A * 2/1974 Gardner ..... H01L 31/02024 257/459
3,909,529 A * 9/1975 Morrow ..... H04M 1/03 381/173
3,960,171 A * 6/1976 Segrest ..... B63C 11/18 137/495
4,013,992 A * 3/1977 Dewberry ..... B06B 1/0603 310/332
4,037,594 A * 7/1977 Riegel ..... B63C 11/06 128/201.27
4,154,981 A * 5/1979 Dewberry ..... H04M 9/08 367/132
4,241,898 A * 12/1980 Segrest ..... B63C 11/12 137/543.15
4,365,351 A * 12/1982 Doerschuk ..... B63C 11/04 2/2.15
4,373,521 A * 2/1983 Wattenbarger ..... B63C 11/24 128/202.13
4,477,041 A * 10/1984 Dunne ..... A42B 3/0473 244/122 AG
4,555,815 A 12/1985 Walther
4,568,159 A * 2/1986 Baldwin ..... A61B 3/113 351/210
4,648,138 A * 3/1987 Brigden ..... A44B 11/266 2/421
4,651,951 A * 3/1987 McFarlane ..... A42B 3/042 244/1 R
4,677,713 A * 7/1987 Copp ..... A44B 11/2588 2/421
4,737,940 A 4/1988 Galet et al.
4,817,596 A 4/1989 Gallet
4,869,245 A 9/1989 Nowakowski et al.
4,885,807 A * 12/1989 Snow, Jr. ..... A42B 3/20 2/424
H000833 H * 11/1990 Brindle ..... A42B 3/042 2/10
4,985,938 A * 1/1991 Snow, Jr. ..... A42B 3/20 2/424
5,022,100 A * 6/1991 Belanger ..... A42B 3/30 128/201.27
5,069,205 A 12/1991 Urso
5,291,880 A 3/1994 Almovist et al.
5,378,962 A * 1/1995 Gray ..... H01J 29/04 313/400
5,488,948 A 2/1996 Dubruille et al.
5,542,627 A * 8/1996 Crenshaw ..... A42B 3/04 2/6.3
5,555,569 A 9/1996 Lane
5,889,871 A * 3/1999 Downs, Jr. ..... H04R 17/00 310/334
5,946,735 A * 9/1999 Bayes ..... A42B 3/08 2/421
6,052,835 A * 4/2000 O'Shea ..... A42B 3/0473 2/425
6,085,358 A * 7/2000 Cogan ..... A42B 3/26 2/424
6,104,816 A * 8/2000 Downs, Jr. ..... H04B 1/385 381/190
6,199,219 B1 * 3/2001 Silken ..... A42B 3/20 2/424
6,381,758 B1 * 5/2002 Roberts, II ..... A42B 3/0473 2/421
6,499,149 B2 * 12/2002 Ashline ..... B60R 22/001 2/411
6,591,430 B1 * 7/2003 Sledge ..... A42B 3/0473 2/421
7,144,024 B2 * 12/2006 Falkner ..... B62J 1/16 224/415
7,328,462 B1 * 2/2008 Straus ..... A42B 3/067 2/411
7,353,828 B1 * 4/2008 Hirshberg ..... A63B 71/085 128/859
7,484,646 B1 * 2/2009 Holmes ..... B63C 11/12 2/422
7,708,018 B1 * 5/2010 Hirshberg ..... A63B 71/085 128/859
7,730,884 B2 * 6/2010 Sato ..... B63C 11/06 128/201.27
7,770,239 B1 * 8/2010 Goldman ..... A42B 3/08 2/415
7,827,617 B2 * 11/2010 Trainor ..... A42B 3/08 2/410
7,866,010 B2 1/2011 Schmidtke et al.
8,061,570 B1 * 11/2011 Holmes ..... B63C 11/12 222/422
8,070,308 B1 * 12/2011 Lo ..... A42B 3/044 362/105
8,120,651 B2 * 2/2012 Ennis ..... A42B 3/042 348/169
8,161,576 B2 * 4/2012 Lemke ..... A42B 3/145 2/417
8,176,913 B2 * 5/2012 Ivory ..... A42B 3/26 128/201.24
8,303,011 B2 * 11/2012 Benden ..... A61G 1/01 280/769
8,393,017 B2 * 3/2013 Sheren ..... A41D 13/0512 2/425
8,692,886 B2 * 4/2014 Ennis ..... A42B 3/042 345/8
8,733,989 B1 * 5/2014 Lo ..... A42B 3/044 362/473
8,813,269 B2 * 8/2014 Bologna ..... A42B 3/20 2/410
8,992,039 B2 * 3/2015 Janice ..... F21L 4/02 362/105
9,131,744 B2 * 9/2015 Erb ..... A42B 3/124
9,194,548 B2 * 11/2015 Janice ..... F21L 4/02
9,241,557 B2 * 1/2016 Abramowitz ..... A45C 13/03
9,265,297 B2 * 2/2016 Warmouth ..... A42B 3/328
9,289,024 B2 * 3/2016 Withnall ..... A42B 3/20
9,320,364 B2 * 4/2016 Mills ..... A47F 1/04
2001/0002087 A1 * 5/2001 Townsend ..... A42B 3/0473 280/801.1
2002/0178492 A1 * 12/2002 Ashline ..... B60R 22/001 2/468
2004/0245741 A1 * 12/2004 Falkner ..... B62J 1/16 280/202
2005/0217006 A1 * 10/2005 Sutter ..... A42B 3/06 2/416
2005/0254136 A1 * 11/2005 Blomqvist ..... B64D 10/00 359/630
2006/0118109 A1 * 6/2006 Sato ..... B63C 11/06 128/201.27
2007/0089219 A1 * 4/2007 Trainor ..... A42B 3/08 2/421
2008/0184451 A1 * 8/2008 Lemke ..... A61F 9/06 2/8.2
2009/0109286 A1 * 4/2009 Ennis ..... A42B 3/042 348/81
2009/0109292 A1 * 4/2009 Ennis ..... A42B 3/042 348/158
2010/0064405 A1 * 3/2010 McGovern ..... F41H 1/04 2/6.7
2010/0088808 A1 * 4/2010 Rietdyk ..... A41D 13/0531 2/467
2010/0132703 A1 * 6/2010 Ivory ..... A62B 18/082 128/201.24

(56) References Cited

U.S. PATENT DOCUMENTS

2010/0242146 A1* 9/2010 Sutter ..... A42B 3/06 2/6.6
2010/0319701 A1 12/2010 Connell
2011/0209272 A1* 9/2011 Drake ..... A42B 3/069 2/411
2011/0271428 A1* 11/2011 Withnall ..... A42B 3/20 2/422
2012/0057331 A1* 3/2012 Janice ..... F21L 4/02 362/105
2012/0278977 A1* 11/2012 Rocklin ..... A42B 3/0473 2/421
2013/0323989 A1* 12/2013 Derrah ..... B63H 21/17 440/6
2013/0333100 A1* 12/2013 Erb ..... A42B 3/124 2/425
2014/0007324 A1* 1/2014 Svehaug ..... A42B 1/08 2/412
2014/0090156 A1* 4/2014 Tom ..... A42B 3/0473 2/421
2014/0259319 A1* 9/2014 Ross ..... A42B 3/18 2/424
2014/0260939 A1* 9/2014 Neal ..... F41H 5/0457 89/36.02
2014/0359921 A1* 12/2014 Ide ..... A42B 3/20 2/424
2015/0176781 A1* 6/2015 Janice ..... F21L 4/02 362/106
2015/0223542 A1* 8/2015 Fischell ..... A42B 3/0473 2/461
2015/0282548 A1* 10/2015 Tulley ..... A42B 3/042 2/422
2016/0021968 A1* 1/2016 Warmouth ..... A42B 3/328 24/517
2016/0029733 A1* 2/2016 Kovarik ..... A42B 3/328 2/411
2016/0199720 A1* 7/2016 Withnall ..... A42B 3/20 2/424

FOREIGN PATENT DOCUMENTS

| | | |
|---|---|---|
| EP | 0794815 | 8/2001 |
| GB | 826198 | 12/1959 |
| GB | 2262766 | 6/1993 |
| WO | WO 2006012870 | 2/2006 |
| WO | WO 2006114505 | 11/2006 |
| WO | WO 2009080532 | 7/2009 |

OTHER PUBLICATIONS

Ops-Score, Inc. Product Literature for O2 Single Strap Kit, available at www.ops-core.com; Nov. 24, 2015; 2 pages.

* cited by examiner

MASK COUPLING APPARATUS

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon. This invention (NC 101,446) is assigned to the United States Government and is available for licensing for commercial purposes. Licensing and technical inquiries may be directed to the Technology Transfer Office, Naval Surface Warfare Center Crane, email: cran_CTO@navy.mil.

BACKGROUND AND SUMMARY OF THE DISCLOSURE

The present disclosure relates generally to coupling apparatuses for securing a mask to a helmet, more particularly, to a mask coupling apparatus configured to allow adjustments at coupling locations on the mask and to facilitate quick coupling and uncoupling to a helmet.

Traditionally, a user desiring to wear a mask had to wear the mask straps over their head with a helmet worn above the straps of the mask. This system required removing the helmet to adjust the straps. Additionally, the adjusting mechanisms generally used were sliding tabs, which were difficult to adjust when being worn in the field, particularly when wearing gloves. This resulted in adjustment of masks being very difficult and time-consuming, and users of the adjusting mechanisms complaining that the adjusting mechanism causes discomfort, such as producing pressure points and inducing headaches.

As such, there is a need for a mask coupling apparatus that connects a mask to a helmet and allows for easy and quick coupling and adjustments and uncoupling in the field.

According to an illustrative embodiment of the present disclosure, an apparatus for coupling a mask to a helmet includes a helmet having a first mounting rail, a second mounting rail and an outer surface, wherein the first and second mounting rails are affixed to the outer surface of the helmet; a mask including a plurality of couplings including a left first coupling, a left second coupling, a right first coupling and a right second coupling; and a strap assembly including a first connector having a linking mechanism including a single strap having a first end and a second end, the first end being coupled to the first mounting rail, a fastener coupled to the second end of the single strap of the linking mechanism, and an adjusting mechanism including a single elastic strap having a first end, a second end, a first portion and a second portion, the first end being coupled to the left first coupling and the second end being coupled to the left second coupling of the mask, the fastener being coupled to the single elastic strap at a point intermediate the first end and the second end, the first portion extending between the first end and the fastener, and the second portion extending between the second end and the fastener, wherein the first end is free to adjust the length of the first portion and the second end is free to adjust the length of the second portion; and a second connector comprising a linking mechanism including a single strap having a first end and a second end, the first end being coupled to the second mounting rail, a quick-release assembly coupled to the second end of the single strap of the linking mechanism, and an adjusting mechanism including a single elastic strap having a first end, a second end, a first portion and a second portion, the first end being coupled to the right first coupling and the second end being coupled to the right second coupling of the mask, the quick-release assembly being coupled to the single elastic strap at a point intermediate the first end and the second end, the first portion extending between the first end and the quick-release assembly, and the second portion extending between the second end and the quick-release assembly, wherein the first end is free to adjust the length of the first portion and the second end is free to adjust the length of the second portion.

According to another illustrative embodiment of the present disclosure, an apparatus for coupling a mask to a helmet comprises a strap assembly including a first connector having a linking mechanism including a single strap having a first end and a second end, the first end being coupled to an outer surface of the helmet, a fastener coupled to the second end of the single strap of the linking mechanism, and an adjusting mechanism including a single elastic strap having a first end, a second end, a first portion and a second portion, the first end and the second end being coupled to a left first coupling and a left second coupling on the mask, the fastener being coupled to the single elastic strap at a point intermediate the first end and the second end, the first portion extending between the first end and the fastener, and the second portion extending between the second end and the fastener, wherein the first end is free to adjust the length of the first portion and the second end is free to adjust the length of the second portion; and a second connector including a linking mechanism having a single strap with a first end and a second end, the first end being coupled to the outer surface of the helmet, a quick-release assembly coupled to the second end of the single strap of the linking mechanism and an adjusting mechanism including a single elastic strap having a first end, a second end, a first portion and a second portion, the first end and the second end being coupled to a right first coupling and a right second coupling on the mask, the quick-release assembly being coupled to the single elastic strap at a point intermediate the first end and the second end, the first portion extending between the first end and the quick-release assembly, and the second portion extending between the second end and the quick-release assembly, wherein the first end is free to adjust the length of the first portion and the second end is free to adjust the length of the second portion.

According to further illustrative embodiment of the present disclosure, a method of securing a mask and a helmet on a user comprises the steps of providing a mask coupling apparatus including a first connector having a linking mechanism including a single strap having a first end and a second end, a fastener coupled to the second end of the single strap of the linking mechanism; and an adjusting mechanism including a single elastic strap having a first end, a second end, a first portion and a second portion, the fastener being coupled to the single elastic strap at a point intermediate the first end and the second end, the first portion extending between the first end and the fastener, and the second portion extending between the second end and the fastener, wherein the first end is free to adjust the length of the first portion and the second end is free to adjust the length of the second portion, and a second connector including a linking mechanism having a single strap including a first end and a second end, a quick-release assembly coupled to the second end of the single strap of the linking mechanism, and an adjusting mechanism including a single elastic strap having a first end, a second end, a first portion and a second portion, the quick-release assembly being coupled to the single elastic strap at a point intermediate the first end and the second end, the first portion extending between the first end and the quick-release assembly, and the second portion extending between the second end and the quick-release assembly, wherein the first end is free to adjust the length of the first portion and the second end is free to adjust the length of the second portion; attaching the first end of the linking mechanisms of the mask coupling apparatus to mounting rails affixed to an outer surface of the helmet; attaching the first and second ends of the elastic straps of the adjusting mechanisms to a plurality of couplings including a left first coupling, a left second coupling, a right first coupling, and a right second coupling on the mask; and adjusting the mask coupling apparatus by pulling the ends of the elastic straps of the first and second connectors.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
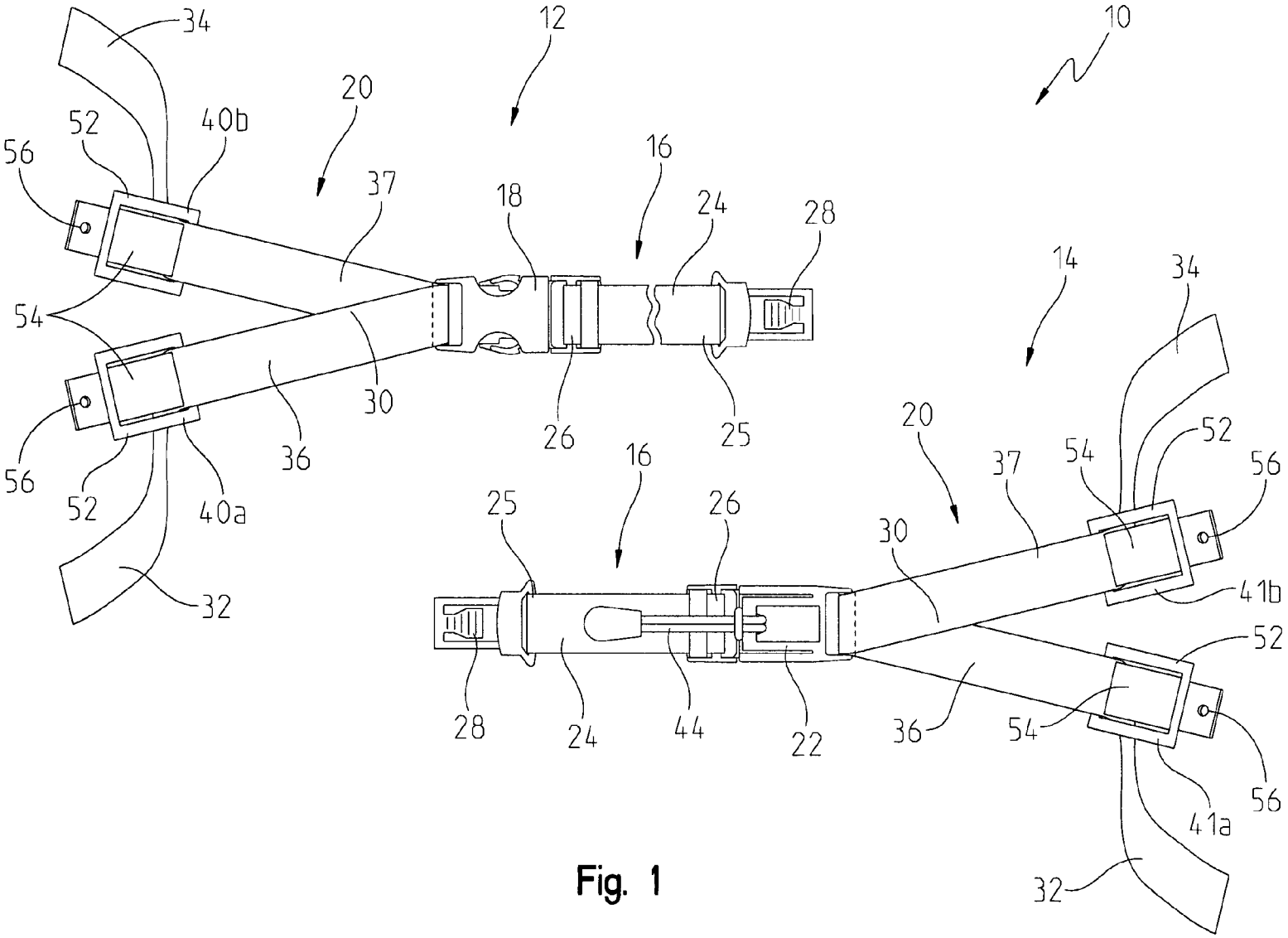
FIG. 1 is a perspective view of a first connector and a second connector of a mask coupling apparatus.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Figure 2:
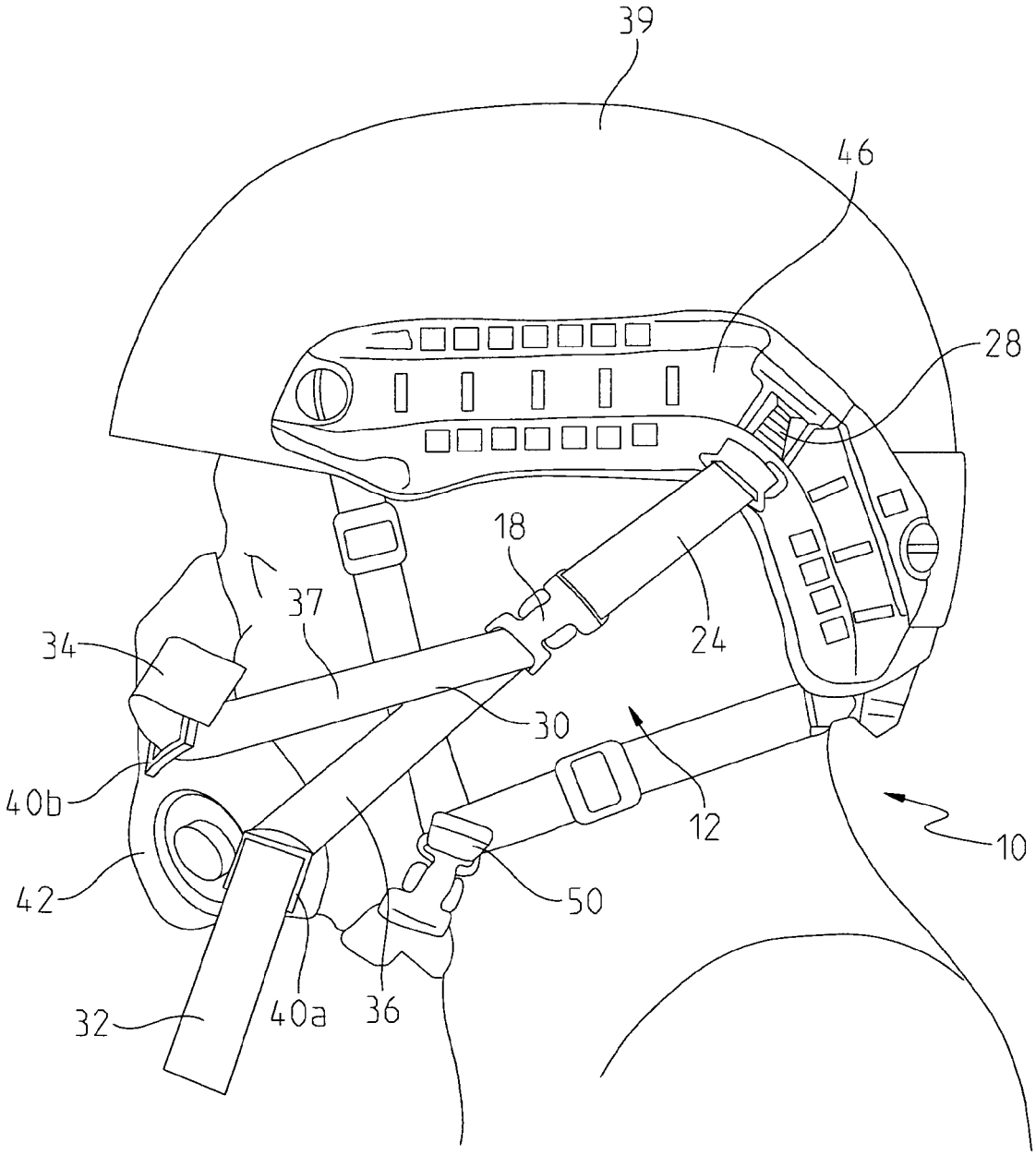
FIG. 2 is a side view of a first connector of a mask coupling apparatus connecting a mask to a helmet.
Figure 3:
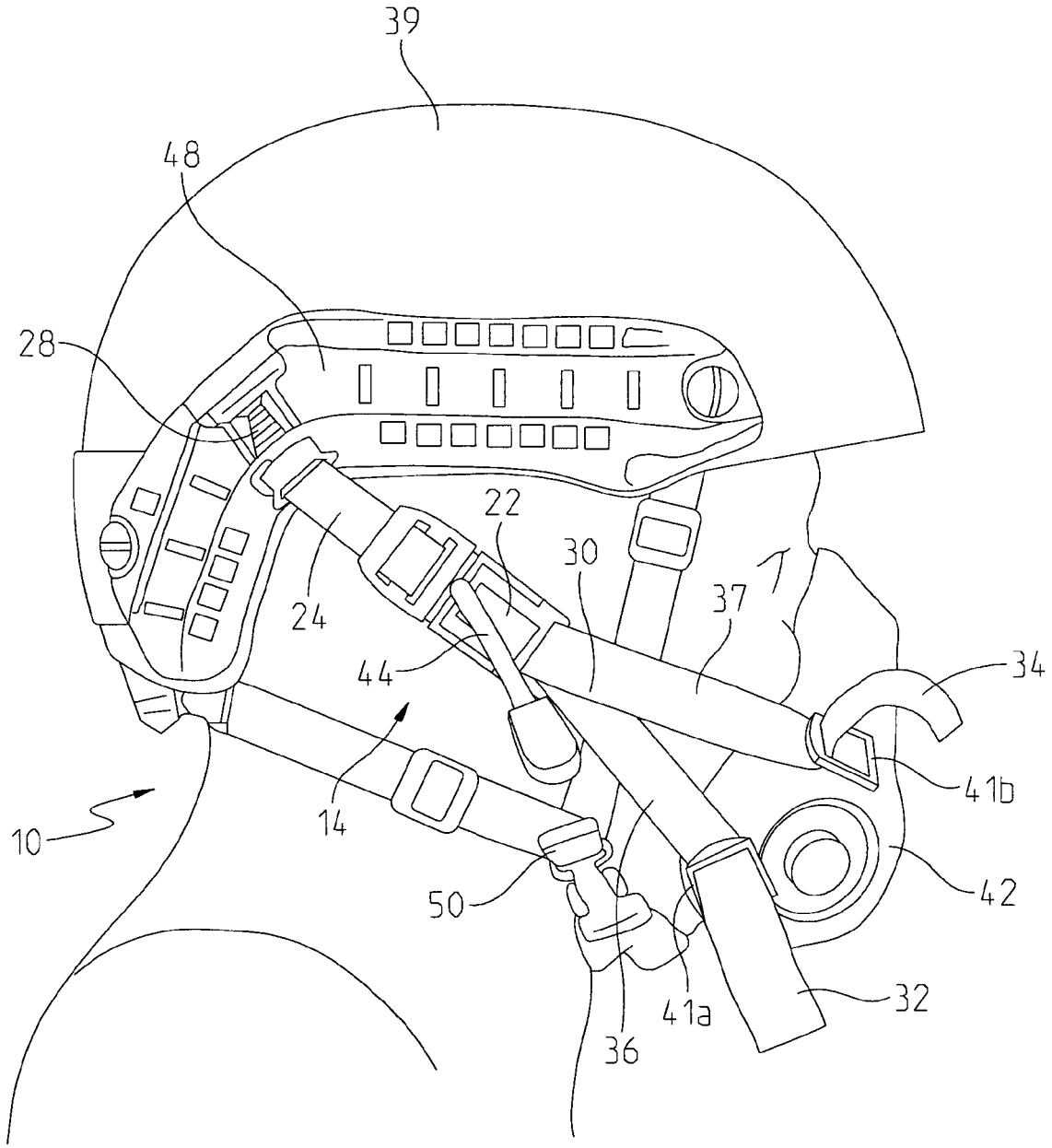
FIG. 3 is a side view of a second connector of a mask coupling apparatus connecting a mask to a helmet.

Referring initially to FIG. 1, a mask coupling apparatus 10 may be shown comprising a first connector 12 and a second connector 14. Mask coupling apparatus 10 is used to couple a helmet 39 to a mask 42 as shown in FIGS. 2 and 3. In various illustrative embodiments, helmet 39 may be an advanced combat helmet (ACH) and mask 42 may be a respirator, which may include at least one filter, or an oxygen mask.

In further detail and still referring to FIG. 1, first connector 12 illustratively includes a linking mechanism 16, a fastener 18, and an adjusting mechanism 20. Linking mechanism 16 generally includes a single strap 24 having a first end 25 and a second end 26, wherein first end 25 may be coupled to helmet 39 (see FIG. 2) via a coupler 28 and second end 26 may be secured to fastener 18.

Figure 4:
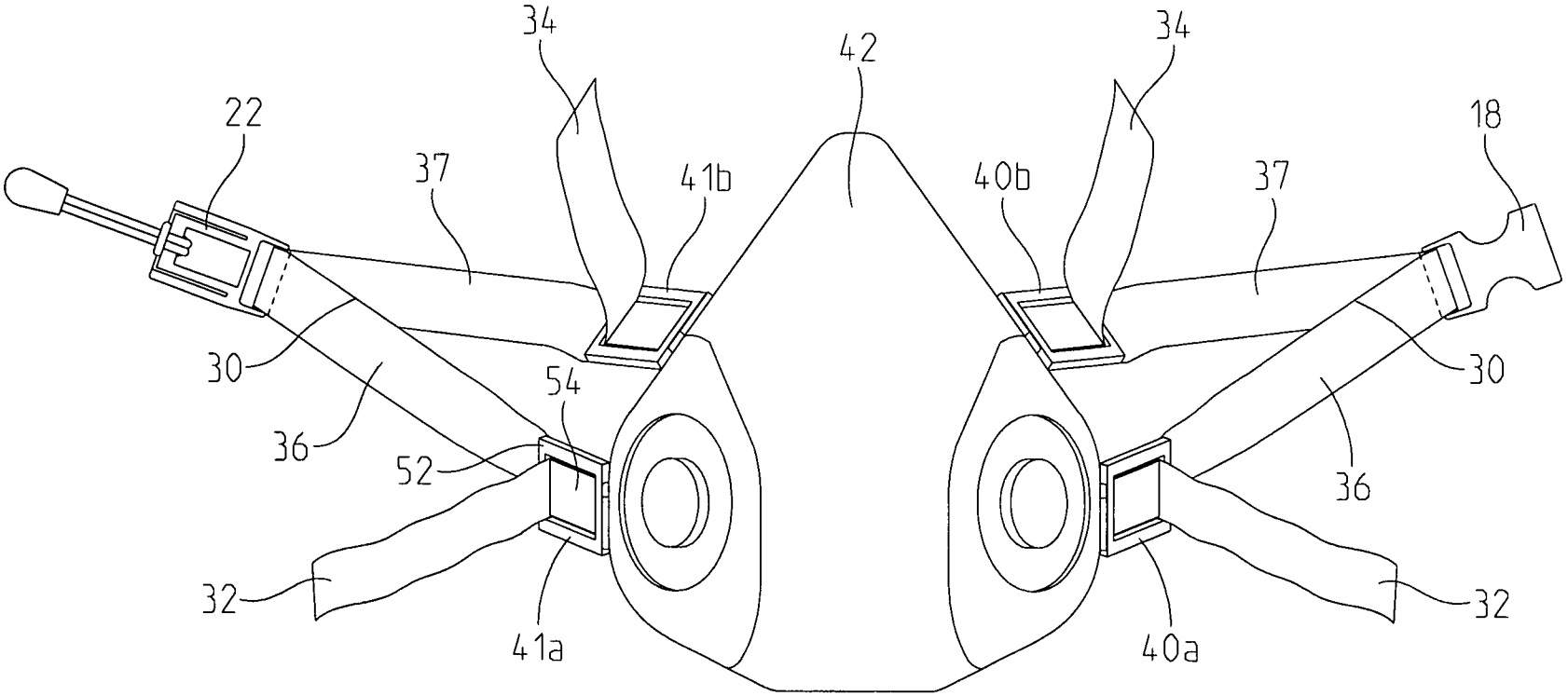
FIG. 4 is a perspective view of a portion of a mask coupling apparatus coupled to a mask.

Adjusting mechanism 20 generally includes a single elastic strap 30 having a first end 32 and a second end 34, wherein fastener 18 is coupled to adjusting mechanism 20 at a position intermediate first end 32 and second end 34 creating a first portion 36 extending between first end 32 and fastener 18 and a second portion 37 extending between second end 34 and fastener 18. Elastic strap 30 is generally formed of a resilient material capable of returning to its normal length or shape after being stretched or pulled, which allows for elastic strap 30 to be pulled for quick adjustments, while still allowing the mask to be snug to the user's face. In an exemplary embodiment, elastic strap 30 is formed of woven elastic or rubber and/or fibers. Further, in various embodiments, first portion 36 and second portion 37 may be sewn together at a position adjacent to fastener 18 to allow first portion 36 and second portion 37 to be adjusted separately. Furthermore, first end 32 and second end 34 are coupled to a plurality of couplings including a left first coupling 40*a* and a left second coupling 40*b* attached to mask 42, as shown in FIG. 4. First and second ends 32, 34 are threaded through couplings 40*a* and 40*b* such that ends 32, 34 are free for adjusting and a portion of elastic strap 30 is secured within couplings 40*a* and 40*b*. In various embodiments, coupling 40*b* may be positioned longitudinally above coupling 40*a*. Furthermore, coupling 40*b* may be positioned on the mask forward of coupling 40*a*. Additionally, couplings 40*a* and 40*b* may be arranged such that their inward facing ends are angled towards each other. Further, in an exemplary embodiment, fastener 18 is a buckle, more particularly a side-release buckle of the type known in the art. Additionally, fastener 18 may be made of plastic or metal.

Still referring to FIG. 1, second connector 14 illustratively includes a linking mechanism 16, a quick-release assembly 22, and an adjusting mechanism 20. Linking mechanism 16 and adjusting mechanism 20 of second connector 14 may be similar to those of first connector 12. Linking mechanism 16 generally includes a single strap 24 having a first end 25 and a second end 26, wherein first end 25 may be coupled to helmet 39 (see FIG. 3) via a coupler 28 and second end 26 may be secured to quick-release assembly 22.

Adjusting mechanism 20 generally includes a single elastic strap 30 having a first end 32 and a second end 34, wherein quick-release assembly 22 is coupled to elastic strap 30 of adjusting mechanism 20 at a position intermediate first end 32 and second end 34 creating a first portion 36 extending between first end 32 and quick-release assembly 22 and a second portion 37 extending between second end 34 and quick-release assembly 22. First portion 36 and second portion 37 may be sewn together at a position adjacent to quick-release assembly 22 to allow first portion 36 and second portion 37 to be adjusted separately. Additionally, first end 32 and second end 34 are each coupled to respective couplings, right first coupling 41*a* and right second coupling 41*b* attached to mask 42, as shown in FIG. 4. Coupling 41*b* may be positioned longitudinally above coupling 41*a*. Furthermore, coupling 41*b* may be positioned forward of coupling 41*a*. Additionally, couplings 41*a*, 41*b* may be arranged such that they are angled towards each other. First and second ends 32, 34 are threaded through couplings 41*a*, 41*b* such that they are free for adjusting and a portion of elastic strap 30 is secured within couplings 41*a*, 41*b*. Furthermore, quick-release assembly 22 generally includes a pull-tab 44 that allows linking mechanism 16 and adjusting mechanism 20 to be separated from one another and allows mask 42 to be removed in a quick manner. In an exemplary embodiment, quick-release assembly 22 is made of plastic and is of conventional design.

With reference now to FIGS. 2 and 3, mask coupling apparatus 10 is shown coupling helmet 39 to mask 42. Helmet 39 includes a first mounting rail 46 (FIG. 2) and a second mounting rail 48 (FIG. 3) affixed to an outer surface of helmet 39. In various embodiments, first mounting rail 46 is affixed to a first side of helmet 39 and second mounting rail 48 is affixed to a second side of helmet 39. In an exemplary embodiment, first connector 12 couples to first mounting rail 46 of helmet 39 via coupler 28 and to mask 42 via couplings 40*a*, 40*b*, and second connector 14 couples to second mounting rail 48 of helmet 39 via coupler 28 and to mask 42 via couplings 41*a*, 41*b*. Furthermore, helmet 39 may also include a securing strap 50, illustratively a chin strap, for securing helmet 39 to the user's head. Strap 50 may be used to secure helmet 39 to the head of the user by extending the strap under the chin of the user. Generally, strap 50 is secured below or under mask coupling apparatus 10.

Referring to FIG. 4, mask 42 includes a plurality of couplers including a left first coupling 40*a*, a left second coupling 40*b*, a first right coupling 41*a*, and a second right coupling 41*b* such that adjusting mechanisms 20 of first connector 12 and second connector 14 are coupled to mask 42 via said couplings 40, 41. More particularly, first and second ends 32, 34 of elastic straps 30 are shown laced through couplings 40, 41 such that first and second portions 36, 37 can be adjusted by pulling outward or backward on ends 32, 34 or pulling couplings 40, 41 away from the face of a user. For instance, to adjust the length of first portion 36, a user may shorten the first portion 36 by pulling outward and/or backward on first end 32 of elastic strap 30, wherein by pulling on strap 30, the user causes strap 30 to be stretched and pulled such that at least a portion of strap 30 passes from behind coupling 40*a*, 41*a* to forward of coupling 40*a*, 41*a*. After releasing first end 32, strap 30 returns to its original length and/or shape. Further, a user may lengthen first portion 36 by pulling coupling 40*a* or 41*a* away from the user's face, wherein strap 30 is stretched and extended such that at least a portion of strap 30 passes from forward of coupling 40*a*, 41*a* to behind coupling 40*a*, 41*a*. Similarly, to adjust the length of second portion 37, a user may pull outward and/or backward on second end 34 of elastic strap 30 to shorten second portion 37 or pull coupling 40*b*, 41*b* away from a user's face to length second portion 37. Furthermore, couplings 40, 41 may generally be any type of coupling device.

In an exemplary embodiment, couplings 40, 41 include a frame 52 and a flexible finger 54, where flexible finger 54 is coupled at one end to frame 52 while the other end is free such that a portion of elastic strap 30 may be pinched or clasped between frame 52 and the free end of flexible finger 54. Additionally, couplings 40, 41 may also include a mounting tab 56 that couples frame 52 of couplings 40, 41 to mask 42 (FIG. 1). The plurality of couplings coupled to mask 42 may include at least two or more couplings. In an exemplary embodiment, the plurality of couplings comprises four couplings.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. An apparatus for coupling a mask to a helmet, the apparatus comprising:

a helmet including a first mounting rail, a second mounting rail and an outer surface, wherein the first and second mounting rails are affixed to the outer surface of the helmet;

a mask including a plurality of couplings including a left first coupling, a left second coupling, a right first coupling and a right second coupling; and a strap assembly including:

a first connector including:

a linking mechanism including a single strap having a first end and a second end, the first end being coupled to the first mounting rail;

a fastener coupled to the second end of the single strap of the linking mechanism; and an adjusting mechanism including a single elastic strap having a first end, a second end, a first portion and a second portion, the first end being coupled to the left first coupling and the second end being coupled to left second coupling of the mask, the fastener being coupled to the single elastic strap at a point intermediate the first end and the second end, the first portion extending between the first end and the fastener, and the second portion extending between the second end and the fastener, wherein the first end is free to adjust the length of the first portion and the second end is free to adjust the length of the second portion; and a second connector including:

a linking mechanism including a single strap having a first end and a second end, the first end being coupled to the second mounting rail;

a quick-release assembly coupled to the second end of the single strap of the linking mechanism; and an adjusting mechanism including a single elastic strap having a first end, a second end, a first portion and a second portion, the first end being coupled to the right first coupling and the second end being coupled to the right second coupling of the mask, the quick-release assembly being coupled to the single elastic strap at a point intermediate the first end and the second end, the first portion extending between the first end and the quick-release assembly, and the second portion extending between the second end and the quick-release assembly, wherein the first end is free to adjust the length of the first portion and the second end is free to adjust the length of the second portion.

2. The apparatus of claim 1, wherein the mask is a respirator.

3. The apparatus of claim 1, wherein the mask is an oxygen mask.

4. The apparatus of claim 1, wherein the first mounting rail is affixed to the outer surface of the helmet at a first side and the second mounting rail is affixed to the outer surface of the helmet at a second side.

5. The apparatus of claim 1, wherein the helmet further comprises a securing strap, the securing strap extending under the apparatus for coupling the mask.

6. The apparatus of claim 1, wherein the fastener is a buckle.

7. The apparatus of claim 1, wherein each of the plurality of couplings includes a frame and a flexible finger.

8. The apparatus of claim 1, wherein the first portion and the second portion of the adjusting mechanism of the first connector are sewn together at a position proximate the fastener.

9. The apparatus of claim 1, wherein the first portion and the second portion of the adjusting mechanism of the second connector are sewn together at a position proximate the quick-release assembly.

10. The apparatus of claim 1, wherein the elastic straps are formed of a resilient material capable of returning to a normal length or shape after being stretched.

11. An apparatus for coupling a mask to a helmet, the apparatus comprising:

a strap assembly including:

a first connector having:

a linking mechanism including a single strap having a first end and a second end, the first end being coupled to an outer surface of the helmet;

a fastener coupled to the second end of the single strap of the linking mechanism; and an adjusting mechanism including a single elastic strap having a first end, a second end, a first portion and a second portion, the first end and the second end being coupled to a left first coupling and a left second coupling on the mask, the fastener being coupled to the single elastic strap at a point intermediate the first end and the second end, the first portion extending between the first end and the fastener, and the second portion extending between the second end and the fastener, wherein the first end is free to adjust the length of the first portion and the second end is free to adjust the length of the second portion; and a second connector including:

a linking mechanism including a single strap having a first end and a second end, the first end being coupled to the outer surface of the helmet;

a quick-release assembly coupled to the second end of the single strap of the linking mechanism; and an adjusting mechanism including a single elastic strap having a first end, a second end, a first portion and a second portion, the first end and the second end being coupled to a right first coupling and a right second coupling, the quick-release assembly being coupled to the single elastic strap at a point intermediate the first end and the second end, the first portion extending between the first end and the quick-release assembly, and the second portion extending between the second end and the quick-release assembly, wherein the first end is free to adjust the length of the first portion and the second end is free to adjust the length of the second portion.

12. The apparatus of claim 11, wherein the mask is a respirator.

13. The apparatus of claim 11, wherein the mask is an oxygen mask.

14. The apparatus of claim 11 further comprising a first mounting rail and a second mounting rail affixed to the outer surface of the helmet, wherein the first connector is coupled to the first mounting rail and the second connector is coupled to the second mounting rail.

15. The apparatus of claim 14, wherein the first mounting rail is affixed to the outer surface at a first side and the second member is affixed to the outer surface at a second side.

16. The apparatus of claim 11, wherein the fastener is a buckle.

17. The apparatus of claim 11, wherein each of the couplings includes a frame and a flexible finger.

18. The apparatus of claim 11, wherein the first portion and the second portion of the adjusting mechanism of the first connector are sewn together at a position proximate the fastener.

19. The apparatus of claim 11, wherein the first portion and the second portion of the adjusting mechanism of the second connector are sewn together at a position proximate the quick-release assembly.

20. A method of securing a mask and a helmet on a user comprising the steps of:

providing a mask coupling apparatus including a first connector having a linking mechanism including a single strap having a first end and a second end; a fastener coupled to the second end of the single strap of the linking mechanism; and an adjusting mechanism including a single elastic strap having a first end, a second end, a first portion and a second portion, the fastener being coupled to the single elastic strap at a point intermediate the first end and the second end, the first portion extending between the first end and the fastener, and the second portion extending between the second end and the fastener, wherein the first end is free to adjust the length of the first portion and the second end is free to adjust the length of the second portion; and a second connector including a linking mechanism having a single strap including a first end and a second end; a quick-release assembly coupled to the second end of the single strap of the linking mechanism; and an adjusting mechanism including a single elastic strap having a first end, a second end, a first portion and a second portion, the quick-release assembly being coupled to the single elastic strap at a point intermediate the first end and the second end, the first portion extending between the first end and the quick-release assembly, and the second portion extending between the second end and the quick-release assembly, wherein the first end is free to adjust the length of the first portion and the second end is free to adjust the length of the second portion;

attaching the first end of the linking mechanisms of the mask coupling apparatus to mounting rails affixed to an outer surface of the helmet;

attaching the first and second ends of the elastic straps of the adjusting mechanisms to a plurality of couplings on the mask including a left first coupling, a left second coupling, a right first coupling, and a right second coupling; and adjusting the mask coupling apparatus by pulling at least one of the first and second ends of the elastic straps of the first and second connectors.

21. The method of claim 20, wherein the single elastic straps are formed of a resilient material capable of returning to a normal length or shape after being stretched.

22. The method of claim 20, wherein the mask may be removed pulling a pull-tab of the quick-release assembly.

23. The method of claim 20, wherein the pulling of at least one of the first and second ends of the elastic strap of the first and second connectors causes at least a portion of the strap to pass between the couplings.

* * * * *